US011735149B2

(12) United States Patent
Zhang

(10) Patent No.: US 11,735,149 B2
(45) Date of Patent: Aug. 22, 2023

(54) DOUBLE-STEPPING LINKAGE PEDAL FOR BASS DRUM OF JAZZ DRUM

(71) Applicant: BEIJING QINYING EDU. TECHNOLOGIES CO., LTD, Beijing (CN)

(72) Inventor: Jiong Zhang, Beijing (CN)

(73) Assignee: BEIJING QINYING EDU. TECHNOLOGIES CO., LTD, Beijing (CN)

( * ) Notice: Subject to any disclaimer, the term of this patent is extended or adjusted under 35 U.S.C. 154(b) by 113 days.

(21) Appl. No.: 17/472,512

(22) Filed: Sep. 10, 2021

(65) Prior Publication Data

US 2022/0208153 A1 Jun. 30, 2022

(30) Foreign Application Priority Data

Dec. 28, 2020 (CN) ..... 202011581621.5

(51) Int. Cl.
*G10D 13/11* (2020.01)
*G10D 13/12* (2020.01)
*G10D 13/02* (2020.01)

(52) U.S. Cl.
CPC ..... *G10D 13/11* (2020.02); *G10D 13/02* (2013.01); *G10D 13/12* (2020.02)

(58) Field of Classification Search
CPC ..... G01D 13/11; G01D 13/12; G01D 13/02
See application file for complete search history.

(56) References Cited

U.S. PATENT DOCUMENTS 1,031,598 A 7/1912 Tobias
1,128,142 A * 2/1915 Hubman ..... G10D 13/11 84/422.2
1,343,163 A * 6/1920 Smith ..... G10D 13/11 84/422.1
1,360,031 A * 11/1920 Scheurer ..... G10D 13/11 84/422.2
1,369,233 A * 2/1921 Fitzgerald ..... G10D 13/11 84/422.2

(Continued)

FOREIGN PATENT DOCUMENTS

JP S5713583 1/1982
JP 2003084758 3/2003

(Continued)

*Primary Examiner* — Robert W Horn
(74) *Attorney, Agent, or Firm* — JCIP Global Inc.

(57) ABSTRACT

A double-stepping linkage pedal for a bass drum of a jazz drum is provided, in which a left pedal assembly is connected to a left hammerhead assembly, so that a front end of the left pedal assembly moves up and down to drive the left hammerhead assembly to swing back and forth. A left tension spring assembly and the left hammerhead assembly are elastically linked to the left pedal assembly in a swinging direction front-rear consistent manner. A right pedal assembly is drivingly connected to a right hammerhead assembly in a front-rear swinging manner, so that a front end of the right pedal assembly moves up and down to drive the right hammerhead assembly to swing back and forth. A right tension spring assembly and the right hammerhead assembly are elastically linked to the right pedal assembly in a swinging direction front-rear consistent manner.

9 Claims, 10 Drawing Sheets

(56) References Cited

U.S. PATENT DOCUMENTS

| | | | | | |
|---|---|---|---|---|---|
| 2,845,830 | A * | 8/1958 | Haviland | G10D 13/11 | 84/422.1 |
| 3,030,847 | A | 4/1962 | Thompson | | |
| 3,968,718 | A * | 7/1976 | Carver | G10D 13/11 | 84/422.1 |
| 3,988,957 | A * | 11/1976 | Escamilla | G10D 13/11 | 84/422.1 |
| 4,188,853 | A * | 2/1980 | Bills | G10D 13/11 | 84/422.1 |
| 4,538,499 | A * | 9/1985 | Livingston | G10D 13/11 | 84/422.1 |
| 4,691,613 | A | 9/1987 | Jacobson | | |
| 4,945,803 | A * | 8/1990 | Norwood | G10D 13/11 | 84/422.1 |
| 5,396,826 | A * | 3/1995 | Lombardi | G10D 13/11 | 84/422.1 |
| 5,427,010 | A * | 6/1995 | Hoshino | G10D 13/12 | 84/422.1 |
| 5,509,342 | A * | 4/1996 | Augsburger | G10D 13/11 | 84/422.1 |
| 5,567,899 | A * | 10/1996 | Hoshino | G10D 13/11 | 84/422.1 |
| 5,591,929 | A * | 1/1997 | Wellman | G10D 13/11 | 84/422.1 |
| 5,994,635 | A * | 11/1999 | Hoshino | G10D 13/11 | 84/422.1 |
| 6,028,259 | A * | 2/2000 | Lombardi | G10D 13/11 | 84/422.1 |
| 6,255,574 | B1 * | 7/2001 | Sapienza | G10D 13/11 | 84/422.1 |
| 7,321,092 | B2 * | 1/2008 | Hauck | G10D 13/11 | 84/422.1 |
| 7,525,031 | B2 * | 4/2009 | Fisher, IV | G10D 13/11 | 84/411 R |
| 7,956,269 | B1 * | 6/2011 | Chen | G10D 13/11 | 84/422.1 |
| 8,053,656 | B1 * | 11/2011 | Chen | G10D 13/11 | 84/422.1 |
| 8,076,562 | B1 * | 12/2011 | Lin | G10D 13/11 | 84/422.1 |
| 8,110,731 | B1 * | 2/2012 | Chen | F16D 3/40 | 84/411 R |
| 8,471,134 | B2 * | 6/2013 | Chang | G10D 13/11 | 84/422.1 |
| 9,595,247 | B2 * | 3/2017 | Benner, Jr. | G10D 13/11 | |
| 9,754,566 | B2 * | 9/2017 | Reens | G10D 13/11 | |
| 2002/0121177 | A1 * | 9/2002 | Sassmannshausen | G10D 13/11 | 84/422.1 |
| 2002/0152872 | A1 * | 10/2002 | O'Donnell | G10D 13/11 | 84/422.1 |
| 2002/0194979 | A1 * | 12/2002 | Hsieh | G10D 13/11 | 84/421 |
| 2007/0131088 | A1 * | 6/2007 | Hauck | G10D 13/11 | 84/422.1 |
| 2007/0137419 | A1 * | 6/2007 | Chen | G10D 13/11 | 74/562 |
| 2008/0196573 | A1 * | 8/2008 | Chang | G10D 13/11 | 84/422.1 |
| 2010/0162874 | A1 * | 7/2010 | Takegawa | G10D 13/11 | 84/422.1 |
| 2022/0208153 | A1 * | 6/2022 | Zhang | G10D 13/02 | |

FOREIGN PATENT DOCUMENTS

| | | |
|---|---|---|
| JP | 2019032445 | 2/2019 |
| TW | 406849 | 9/2000 |
| TW | M381149 | 5/2010 |

* cited by examiner

DOUBLE-STEPPING LINKAGE PEDAL FOR BASS DRUM OF JAZZ DRUM

CROSS-REFERENCE TO RELATED APPLICATIONS

This application claims the priority benefit of Chinese application serial no. 202011581621.5, filed on Dec. 28, 2020. The entirety of the above-mentioned patent application is hereby incorporated by reference herein and made a part of this specification.

TECHNICAL FIELD

The present invention relates to a part of a jazz drum, in particular to a double-stepping linkage pedal for a bass drum of a jazz drum.

BACKGROUND

The traditional double-stepping chain pedal for a bass drum of a traditional jazz drum currently sold in the market and used by musicians is designed in the following structure: a right pedal of a traditional pedal uses an upright column as a main support structure of the pedal, and a main shaft transversely passes through a bearing at the upper end of the upright column; a chain wheel and a hammerhead rod seat are sequentially fixed on the left side of the upright column, and a tension spring sleeve is fixedly connected to the right side of the upright column; and a tension spring clamp arm and so on are installed on the tension spring sleeve. A left stepping hammer achieves the same working principle through a connecting rod. This traditional chain pedal moves with the main shaft rotating on the bearing, thus driving both the hammerheads and the tension springs to move respectively in opposite directions on two sides. When a pedal is stepped down, the pedal drives a chain to pull down the chain wheel and the hammerhead rod seat that is fixed on the main shaft to move clockwise forwards. On the contrary, the reversed tension spring sleeve moves reversely counterclockwise backwards to pull a tension spring ring, and the hammerhead hits the bass drum at this time. When the foot is lifted, there is no force on the pedal to press down it, and the pedal is lifted up under the action of the tension spring. The tension of the tension spring also causes the main shaft to rotate in the reversed direction, which in turn drives the hammerhead rod seat to move counterclockwise backwards and leave from the bass drum. At the same time, the reversed tension spring moves clockwise forwards under the action of its own rebound force to pull the tension spring ring. Since the pedal with such a structure requires a human foot to exert force when striking, and the hammerhead rod seat and the tension spring move in completely opposite directions, the strength loss is relatively large, causes the striking is often weak, and a user has the empty feeling of stepping on soft things. Due to the acting force of the tension spring, the reversed force of the reversed hammerhead rod seat will reduce the force of pulling the hammerhead rod seat to rebound. Thus, the rebound force is insufficient, the force is small, and causes the rebound is slow. This will cause the user to unconsciously increase the strength of the foot, so that the strength of the striking force is often not well controlled to be sometimes large and sometimes small, and may further causes excessive stepping. When the foot is released, since the chain drives the pedal up, the rebound of the pedal is slow, and the force is small, the pedal does not fit the foot during continuous changing stepping, and it takes a long time to adapt to the feeling of stepping down and rebounding. The tone of striking the drum surface is soft and untransparent.

SUMMARY

The present invention is implemented in order to solve the problems in the prior art. The purpose of the present disclosure is to provide a double-stepping linkage pedal for a bass drum of a jazz drum, wherein the down-stepping force is easy to be controlled, the striking tone is transparent, and the loss of the down-stepping force and rebound force is reduced, so that the hammerheads move more smoothly, and the pedal fits the foot and rebounds fast with easier control.

A double-stepping linkage pedal for a bass drum of a jazz drum in the present invention includes a left pedal assembly, a right pedal assembly, a left hammerhead assembly, a right hammerhead assembly, a left tension spring assembly and a right tension spring assembly, wherein the left pedal assembly is drivingly connected to the left hammerhead assembly in a front-rear swinging manner so that a front end of the left pedal assembly moves up and down to drive the left hammerhead assembly to swing back and forth; the left tension spring assembly and the left hammerhead assembly are elastically linked to the left pedal assembly in a swinging direction front-rear consistent manner; the right pedal assembly is drivingly connected to the right hammerhead assembly in a front-rear swinging manner so that a front end of the right pedal assembly moves up and down to drive the right hammerhead assembly to swing back and forth; and the right tension spring assembly and the right hammerhead assembly are elastically linked to the right pedal assembly in a swinging direction front-rear consistent manner.

A double-stepping linkage pedal for a bass drum of a jazz drum in the present invention may also be as follows:

Each left hammerhead assembly and right hammerhead assembly includes a hammerhead rod and a hammerhead fixed on the top of the hammerhead rod in a position-adjustable manner, wherein a lower part of each hammerhead rod is respectively fixed to a moving part of the corresponding left pedal assembly and a moving part of the corresponding right pedal assembly; an upper part of the left tension spring assembly and an upper part of the right tension spring assembly are fixed to the hammerhead rod at the corresponding side in a position-adjustable manner; a lower part of the left tension spring assembly and a lower part of the right tension spring assembly are respectively rotatably connected to the corresponding left pedal assembly and the corresponding right pedal assembly in a position-adjustable manner, so that a swinging direction of the left tension spring assembly and a swinging direction of the right tension spring assembly are respectively consistent with a front-back swinging direction of the corresponding hammerhead rod.

Each hammerhead rod is fixed on the moving part of the corresponding left pedal assembly and the moving part of the corresponding right pedal assembly in a position-adjustable manner through a hammerhead rod seat; the lower part of each hammerhead rod is fixedly connected to an upper part of the corresponding hammerhead rod seat in a position-adjustable manner; and each hammerhead rod seat is detachably fixedly connected to the moving part of the corresponding left pedal assembly and the moving part of the corresponding right pedal assembly.

Each left tension spring assembly and right tension spring assembly includes a tension spring and a tension spring clamp, wherein an upper part of each tension spring is fixedly connected with the upper part of the corresponding hammerhead rod seat in a position-adjustable manner, and a lower part of each tension spring is hinged on the corresponding tension spring clamp; the lower parts of the hammerhead rod seats are provided with a main shaft, and each tension spring clamp is detachably fixed on the other side of the main shaft in a rotatably position-adjustable manner; the main shaft sequentially penetrates through the left hammerhead rod seat, the left tension spring clamp, the right hammerhead rod seat and the right tension spring clamp from left to right, and the lower end of the left hammerhead rod seat and the right hammerhead rod seat are respectively rotatably connected to the main shaft.

Each left pedal assembly and right pedal assembly includes an upright column assembly, a foot pedal for resting a foot, a bottom plate and a pedal driving device, wherein the bottom of each upright column assembly is fixed on the corresponding bottom plate; an upper part of each upright column assembly supports the left hammerhead assembly and the right hammerhead assembly at a corresponding position; an upper part of each pedal driving device is drivingly connected to the left hammerhead assembly and the right hammerhead assembly at a corresponding position; a lower part of each pedal driving device is connected to the bottom plate at a corresponding position; a rear end of each foot pedal is connected to the corresponding bottom plate; and the initial position of a front end of each foot pedal is higher than the position of the rear end of the foot pedal.

The rear end of each foot pedal is hinged with a rear part of the corresponding bottom plate, and the front end of each foot pedal is hinged with the corresponding pedal driving device.

Each pedal driving device includes a driver and a linkage device, wherein one end of each driver is hinged with the front end of the corresponding foot pedal, the other end of each driver is hinged with the corresponding linkage device, and each linkage device is respectively fixed to the lower part of the corresponding left hammerhead assembly and the lower part of the corresponding right hammerhead assembly.

Each driver includes a bent rod and a chain, wherein a rear end of each bent rod is hinged with the front end of the corresponding foot pedal, a front end of each bent rod is in clearance swing connection with a lower half section of the corresponding chain, and a lower end of each chain is connected to the corresponding bottom plate; each linkage device is a chain wheel, each chain wheel is connected with an upper part of the corresponding chain, and each chain wheel is respectively fixed to the lower part of the corresponding left hammerhead assembly and the lower part of the corresponding right hammerhead assembly.

The linkage device in the left pedal assembly is fixed to the lower part of the left hammerhead assembly through a connecting rod, a left end of the connecting rod is fixed to the linkage device in the left pedal assembly, and a right end of the connecting rod is fixed to the lower part of the left hammerhead assembly.

A linkage shaft is fixed in the center of the linkage device in the left pedal assembly, and a right end of the linkage shaft is fixed to the left end of the connecting rod through a shaft locking device.

The double-stepping linkage pedal for the bass drum of the jazz drum in the present invention includes the left pedal assembly, the right pedal assembly, the left hammerhead assembly, the right hammerhead assembly, the left tension spring assembly and the right tension spring assembly, wherein the left pedal assembly is drivingly connected to the left hammerhead assembly in a front-rear swinging manner so that the front end of the left pedal assembly moves up and down to drive the left hammerhead assembly to swing back and forth; the left tension spring assembly and the left hammerhead assembly are elastically linked to the left pedal assembly in the swinging direction front-rear consistent manner; the right pedal assembly is drivingly connected to the right hammerhead assembly in a front-rear swinging manner so that the front end of the right pedal assembly moves up and down to drive the right hammerhead assembly to swing back and forth; and the right tension spring assembly and the right hammerhead assembly are elastically linked to the right pedal assembly in the swinging direction front-rear consistent manner. In this way, because the left pedal assembly and the right pedal assembly can respectively drive the left hammerhead assembly and the right hammerhead assembly to swing forth and back, so that the hammerhead of the left hammerhead assembly and the hammerhead of the right hammerhead assembly can respectively strike the bass drum or leave away from the bass drum. If a user steps down on the left pedal assembly or the right pedal assembly, the corresponding left hammerhead assembly and the corresponding right hammerhead assembly move clockwise, thereby driving a striking component positioned in front to beat the bass drum to generate a sound. Furthermore, because the left hammerhead assembly and the left tension spring assembly are linked to the corresponding left pedal assembly in the same swinging direction, and the right hammerhead assembly and the right tension spring assembly are linked to the right pedal assembly in the same swinging direction, the left tension spring assembly and the right tension spring assembly also swing clockwise forwards. The left tension spring assembly and the right tension spring assembly have the same action because they are in the same direction. After the striking, the left pedal device is released or the right pedal device is released to return their original position; the left spring assembly and the right spring assembly are not pulled by an external force and they rebound quickly under the action of an elastic force, and then stay away from the bass drum to accumulate power in preparation for the next hammering of the bass drum. Because the rotational swinging directions of the left tension spring assembly and the left hammerhead assembly are the same, and the rotational swinging directions of the right tension spring assembly and the right hammerhead assembly are the same, the two have no interference in the hedging direction and no dispersion effect in the direction of the dispersion force, which can effectively avoid the loss of greater force. Therefore, when striking and releasing to rebound, the force is strong, the rebound is also fast, the strength perception is easier, the strength is held more accurately, the fitting for feet is good, and the tone after the striking is transparent. The double-stepping linkage pedal for the bass drum of the jazz drum according to the present invention has the following advantages over the prior art: the down-stepping force is easy to control, the striking tone is transparent, and the loss of the down-stepping force and rebound force is reduced, so that the hammerheads move more smoothly, and the pedal fits the foot and rebounds fast with easier control.

DETAILED DESCRIPTION OF THE EMBODIMENTS

Figure 1:
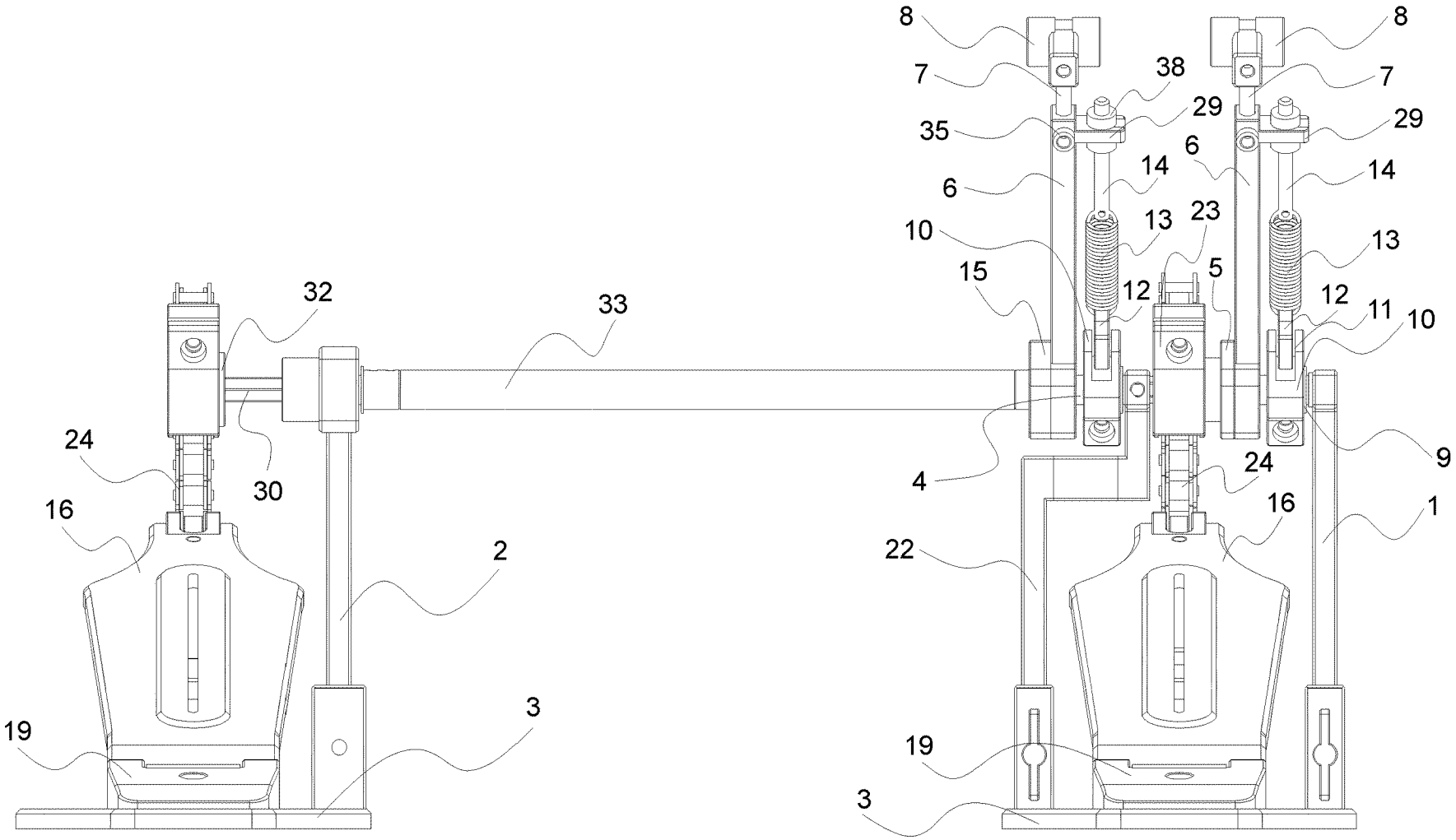
FIG. 1 is a schematic diagram of the overall structure of one embodiment of a double-stepping linkage pedal for a bass drum of a jazz drum according to the present invention.
Figure 2:
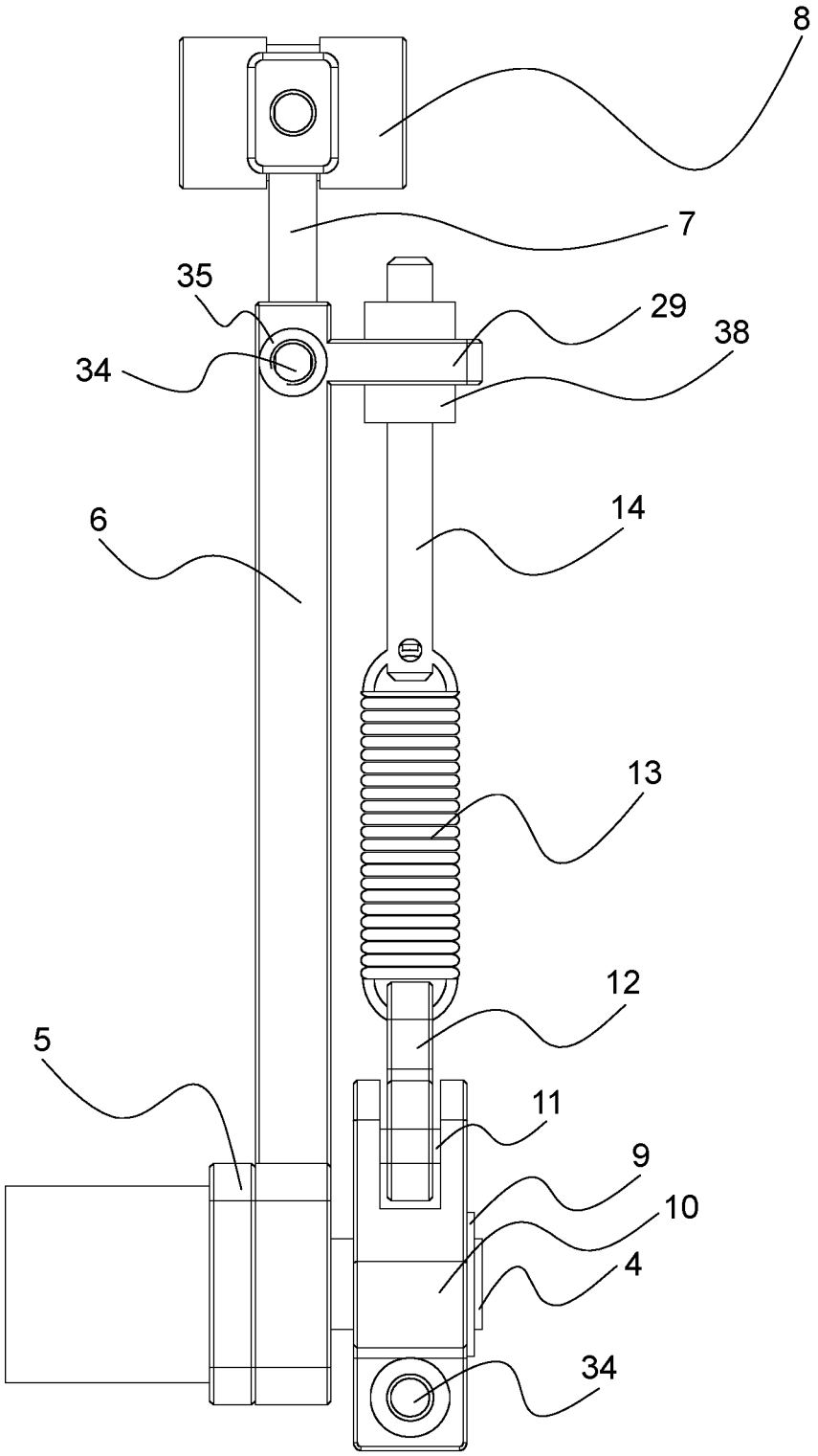
FIG. 2 is an assembly diagram of a right hammerhead assembly and a right tension spring assembly of the double-stepping linkage pedal for the bass drum of the jazz drum according to the present invention.
Figure 3:
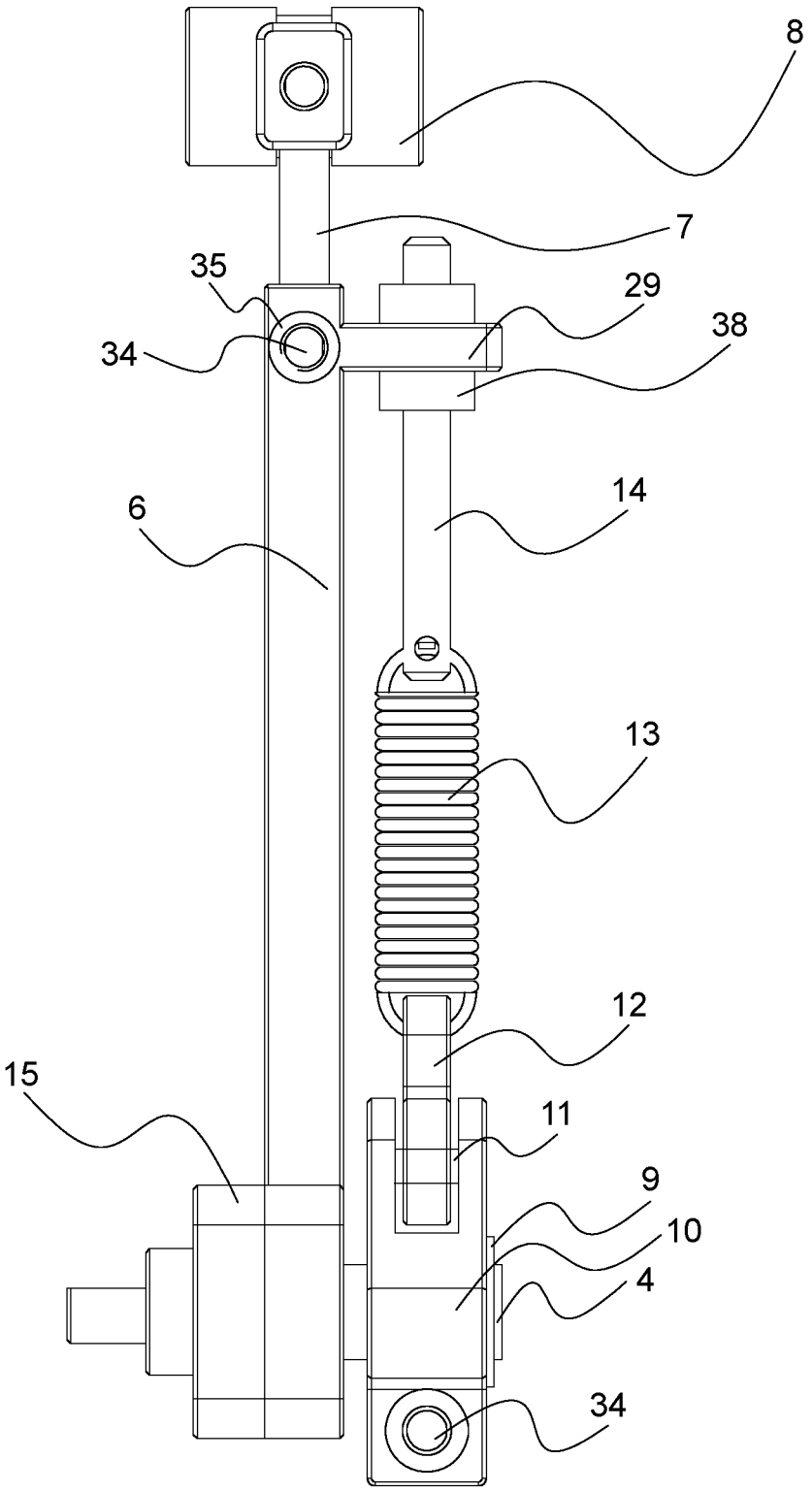
FIG. 3 is an assembly diagram of a left hammerhead assembly and a left tension spring assembly of the double-stepping linkage pedal for the bass drum of the jazz drum according to the present invention.
Figure 4:
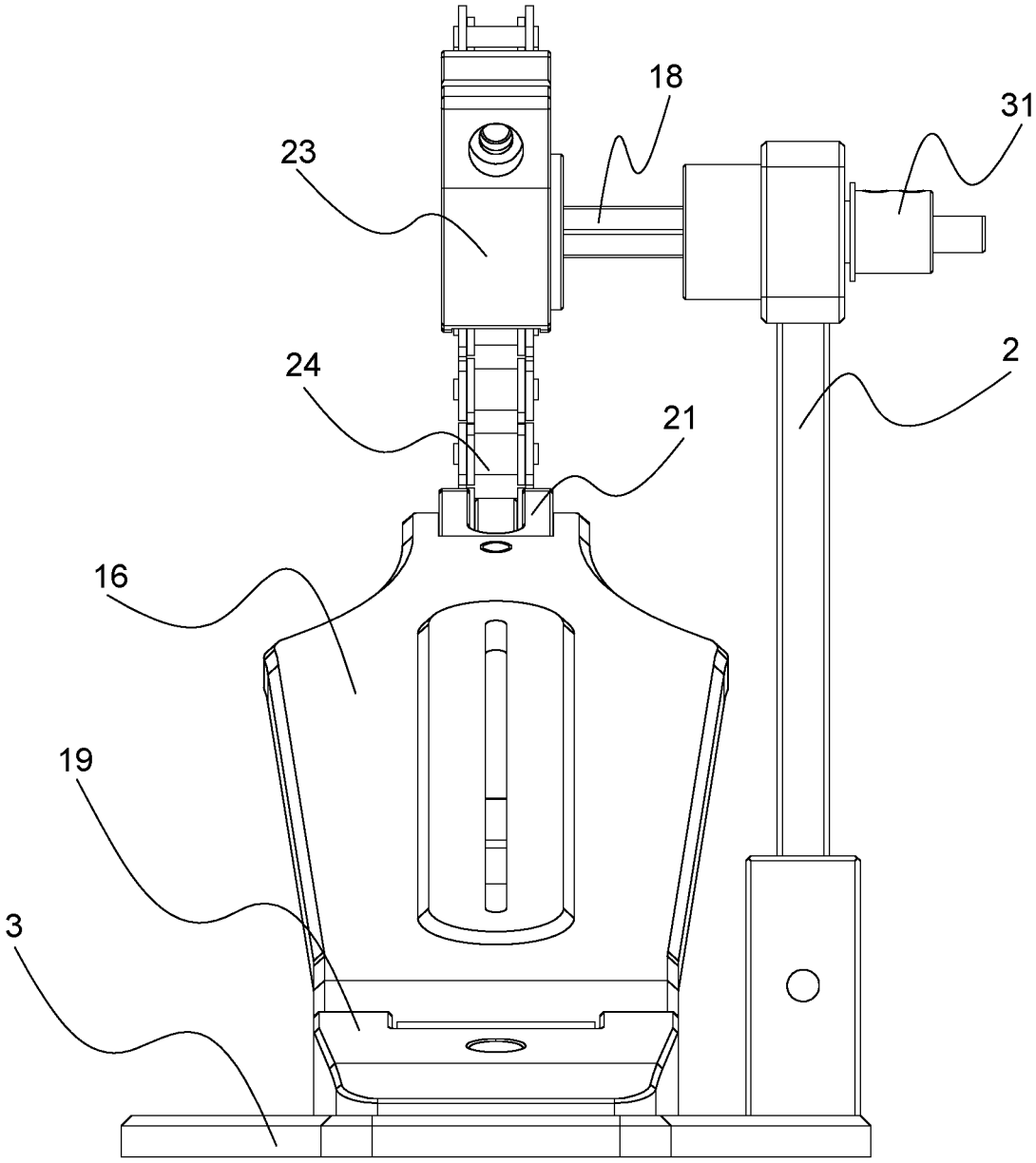
FIG. 4 is a structural schematic diagram of a left pedal assembly of the double-stepping linkage pedal for the bass drum of the jazz drum according to the present invention.
Figure 5:
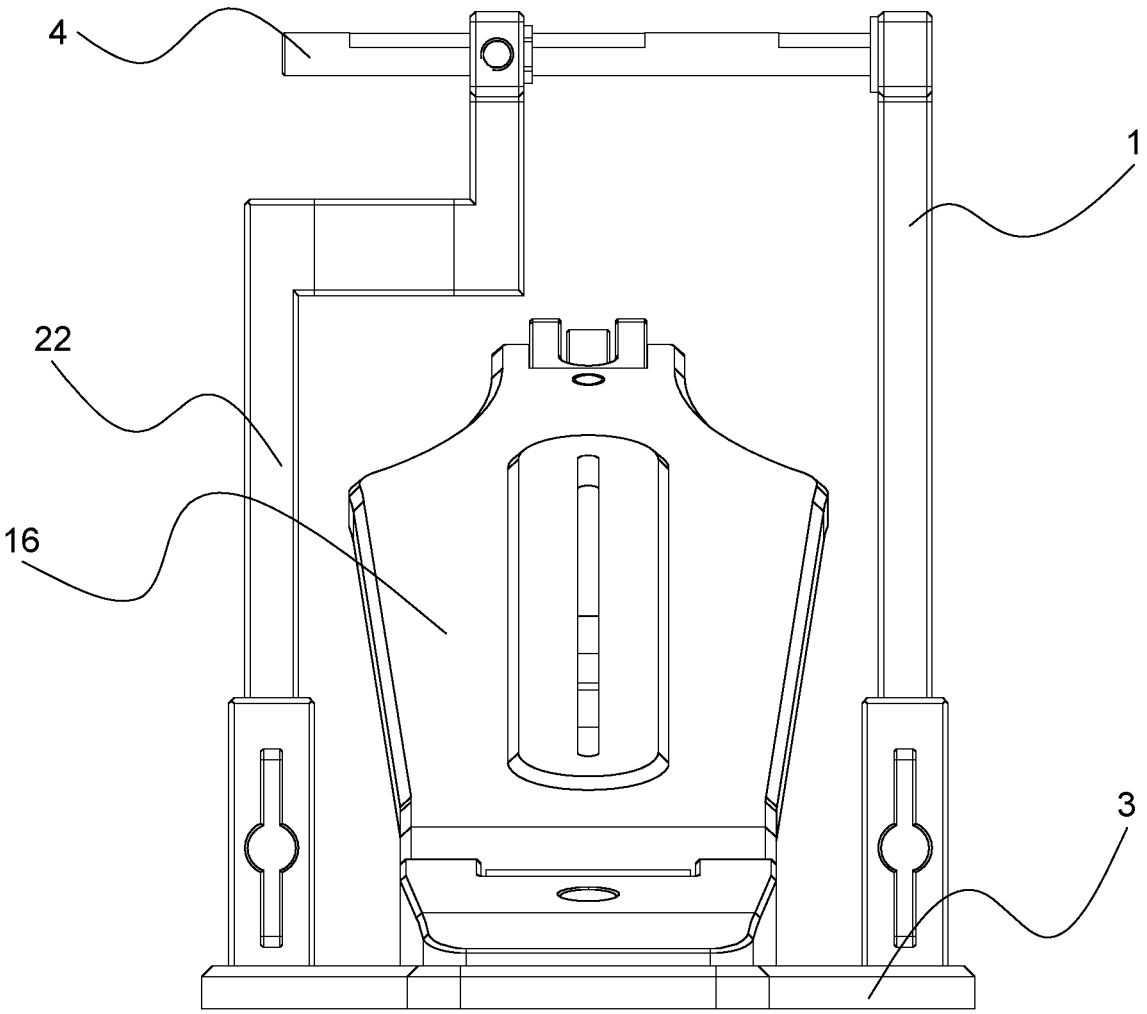
FIG. 5 is a schematic diagram of the connection between a bottom plate, an upright column and a main shaft of the double-stepping linkage pedal for the bass drum of the jazz drum according to the present invention.
Figure 6:
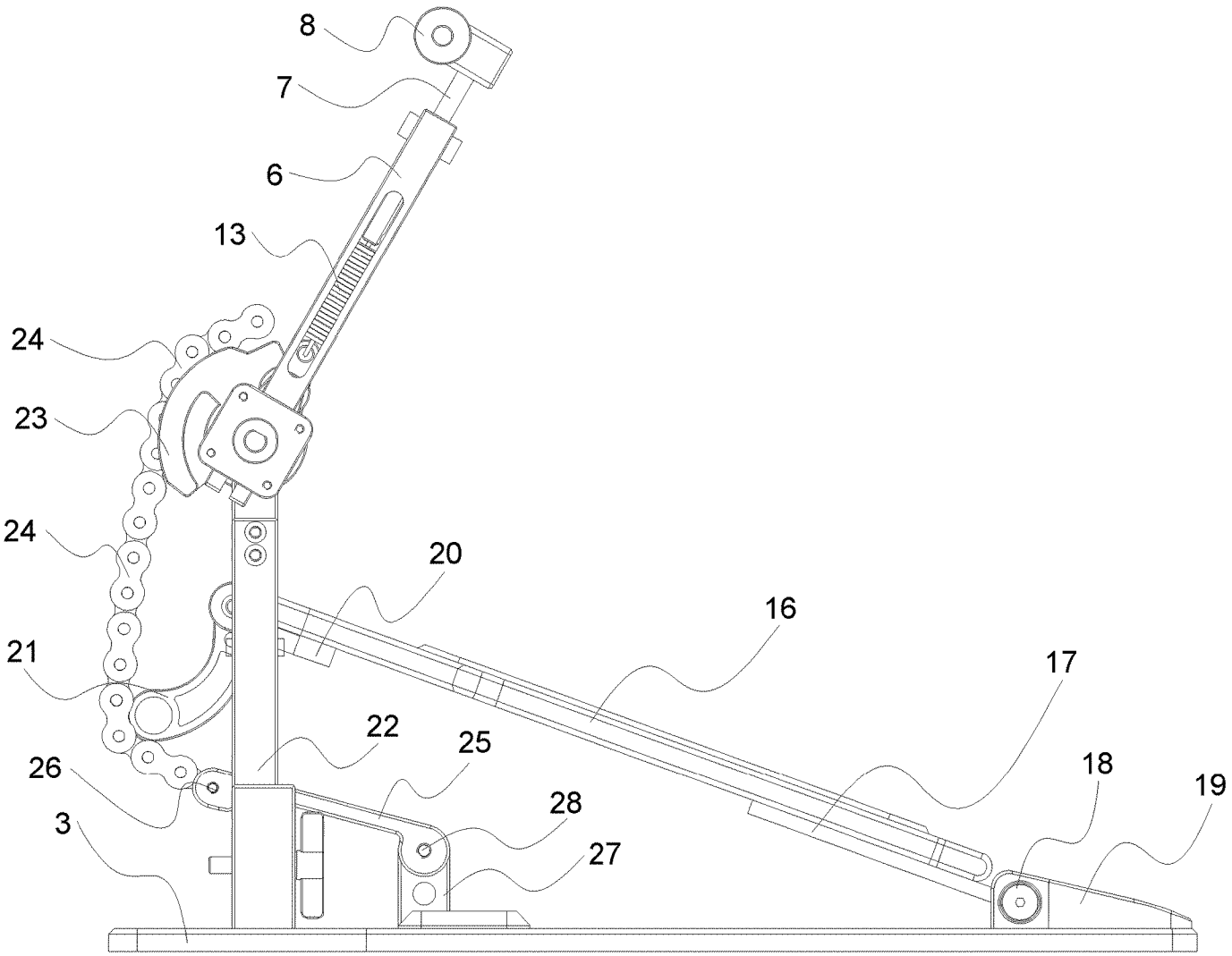
FIG. 6 is a left view of a right pedal assembly of the double-stepping linkage pedal for the bass drum of the jazz drum according to the present invention.
Figure 7:
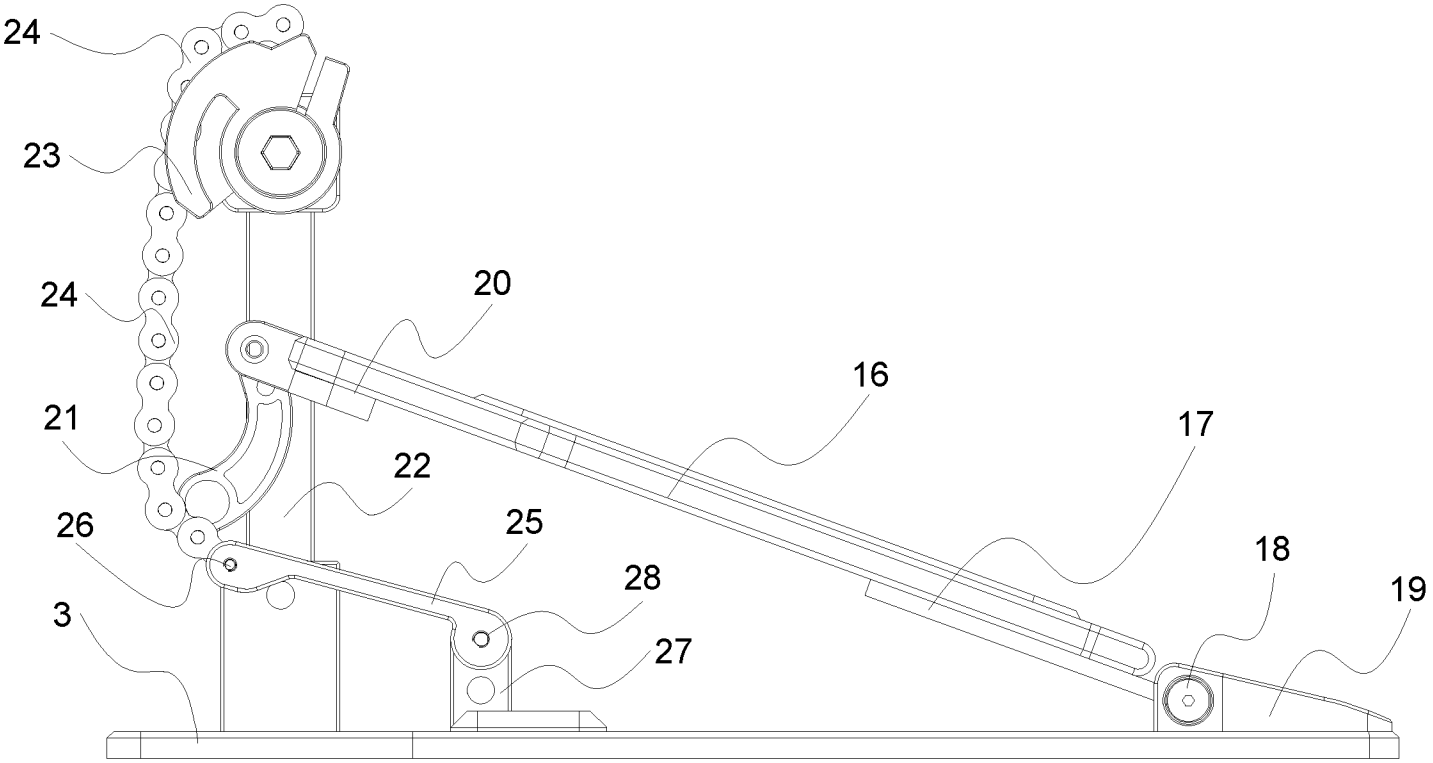
FIG. 7 is a left view of a left pedal assembly of the double-stepping linkage pedal for the bass drum of the jazz drum according to the present invention.
Figure 8:
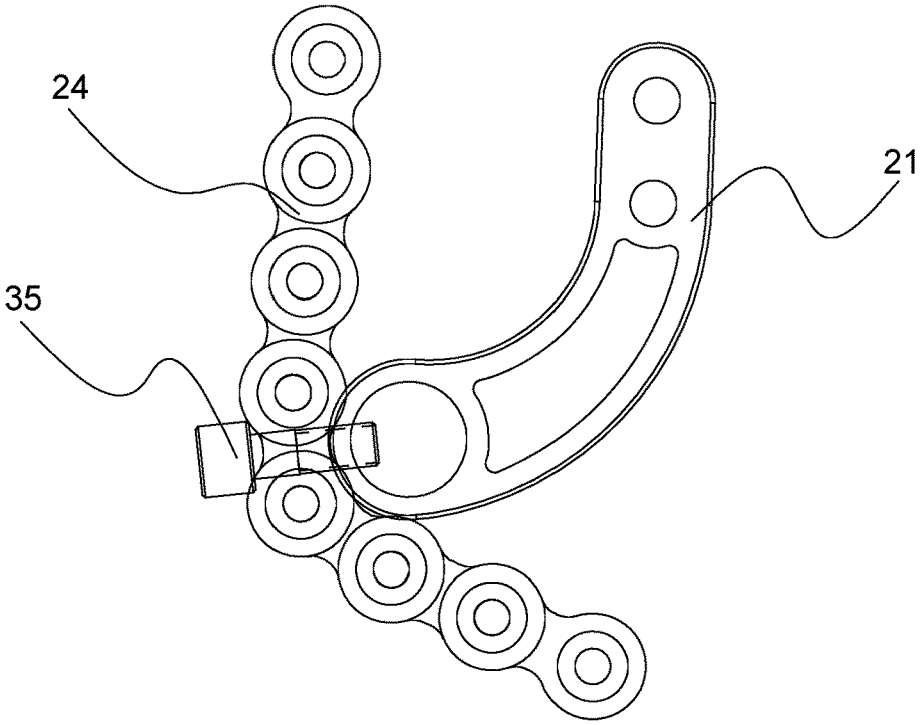
FIG. 8 is an enlarged view of the partial connection between a chain and a bent rod of the double-stepping linkage pedal for the bass drum of the jazz drum according to the present invention.
Figure 9:
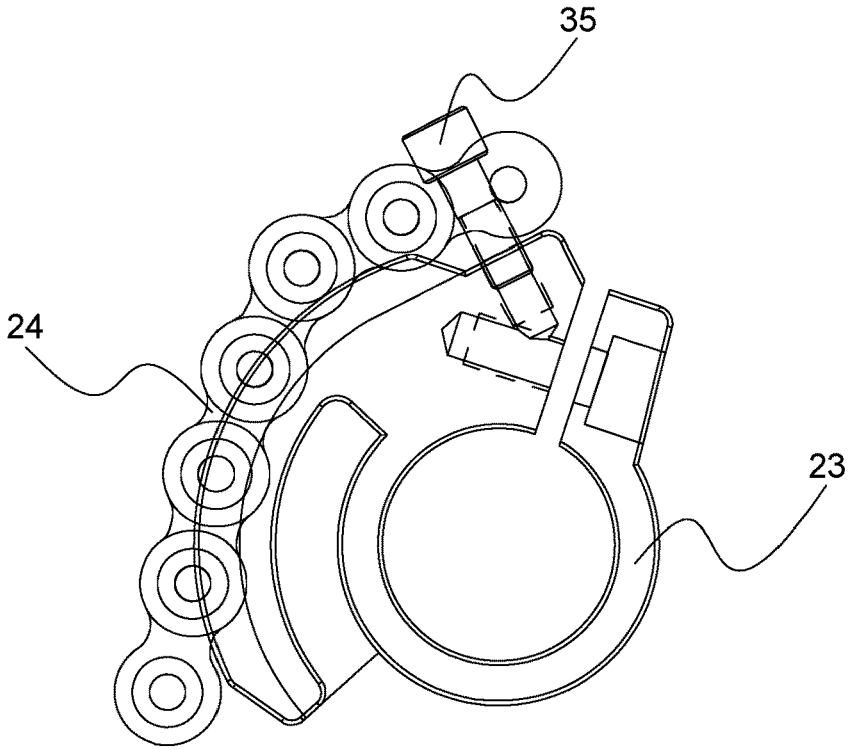
FIG. 9 is an enlarged view of the partial connection between the chain and a chain wheel of the double-stepping linkage pedal for the bass drum of the jazz drum according to the present invention.
Figure 10:
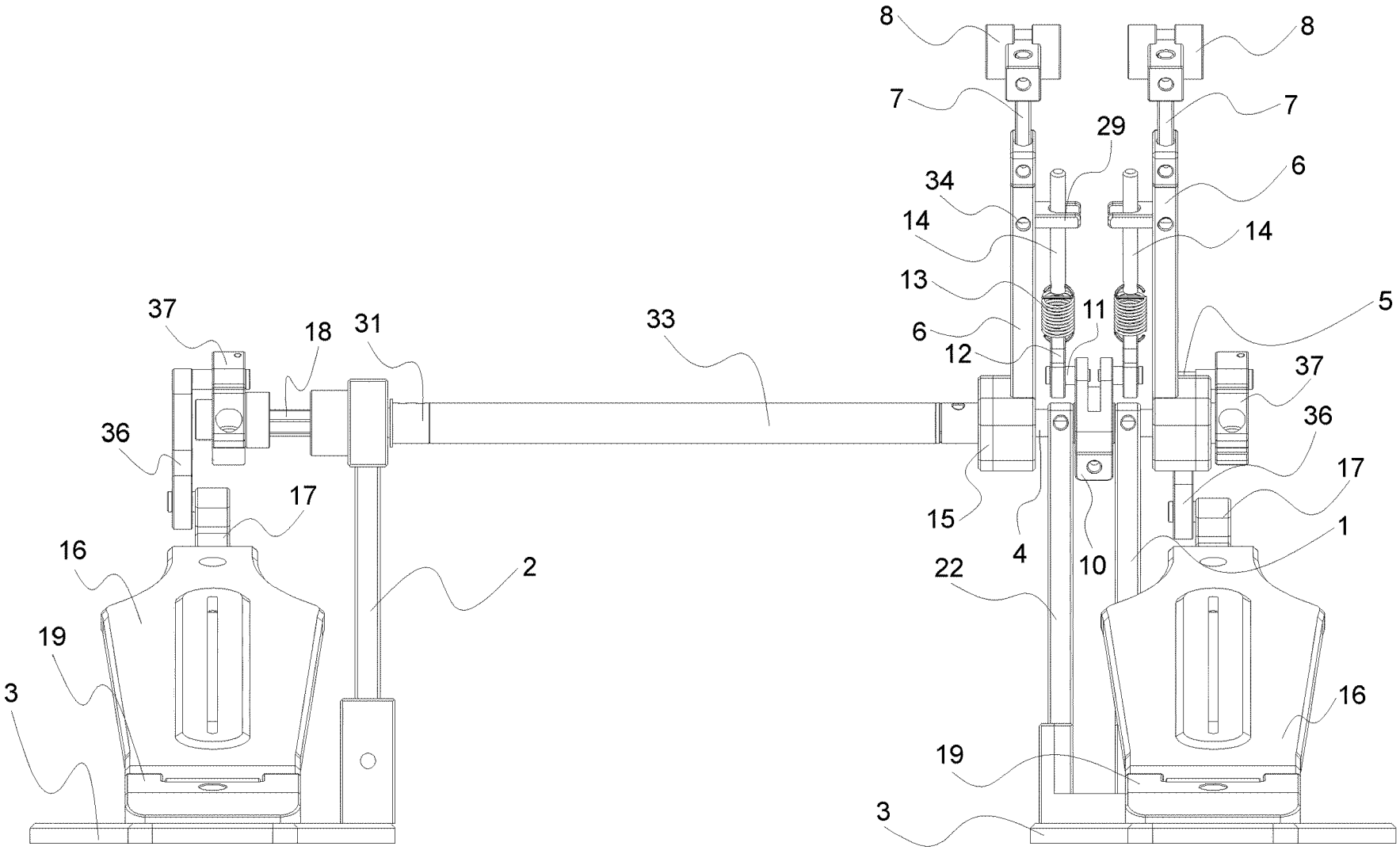
FIG. 10 is an overall schematic diagram of another embodiment of a double-stepping linkage pedal for a bass drum of a jazz drum according to the present invention.
Figure 11:
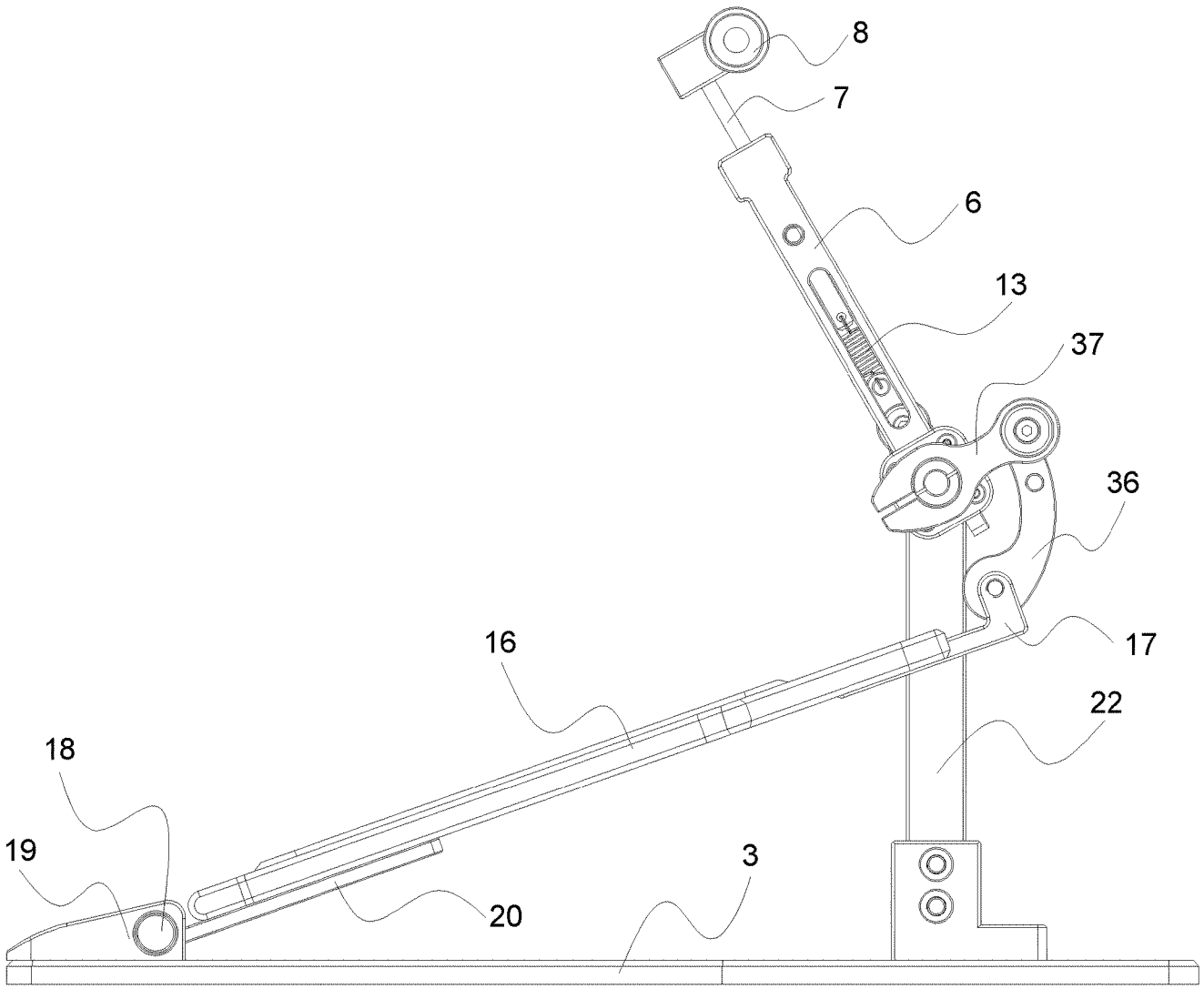
FIG. 11 is a schematic diagram of a right pedal assembly of another embodiment of the double-stepping linkage pedal for the bass drum of the jazz drum according to the present invention.

Hereinafter, a double-stepping linkage pedal for a bass drum of a jazz drum according to the present invention will be further described in detail with reference to FIGS. 1 to 11 of the accompanying drawings.

Referring to FIGS. 1 to 11, a double-stepping linkage pedal for a bass drum of a jazz drum in the present invention includes a left pedal assembly, a right pedal assembly, a left hammerhead assembly, a right hammerhead assembly, a left tension spring assembly and a right tension spring assembly, wherein the left pedal assembly is drivingly connected to the left hammerhead assembly in a front-rear swinging manner so that a front end of the left pedal assembly moves up and down to drive the left hammerhead assembly to swing back and forth; the left tension spring assembly and the left hammerhead assembly are elastically linked to the left pedal assembly in a swinging direction front-rear consistent manner; the right pedal assembly is drivingly connected to the right hammerhead assembly in a front-rear swinging manner so that a front end of the right pedal assembly moves up and down to drive the right hammerhead assembly to swing back and forth; and the right tension spring assembly and the right hammerhead assembly are elastically linked to the right pedal assembly in a swinging direction front-rear consistent manner. In this way, because the left pedal assembly and the right pedal assembly can respectively drive the left hammerhead assembly and the right hammerhead assembly to swing front and back, so that a hammerhead 8 of the left hammerhead assembly and a hammerhead 8 of the right hammerhead assembly can respectively strike the bass drum or leave away from the bass drum. If a user steps down on the left pedal assembly or the right pedal assembly, the corresponding left hammerhead assembly and the corresponding right hammerhead assembly move clockwise, thereby driving a striking component positioned in front to beat the bass drum to generate a sound. Furthermore, because the left hammerhead assembly and the left tension spring assembly are linked to the corresponding left pedal assembly in the same swinging direction, and the right hammerhead assembly and the right tension spring assembly are linked to the right pedal assembly in the same swinging direction, the left tension spring assembly and the right tension spring assembly also swing clockwise forwards. The left tension spring assembly and the right tension spring assembly have the same action because they are in the same direction. After the striking, the left pedal device is released or a right pedal device is released to return their original position; the left spring assembly and the right spring assembly are not pulled by an external force and they rebound quickly under the action of an elastic force, and then stay away from the bass drum to accumulate power in preparation for the next hammering of the bass drum. Because the rotational swinging directions of the left tension spring assembly and the left hammerhead assembly are the same, and the rotational swinging directions of the right tension spring assembly and the right hammerhead assembly are the same, the two have no interference in the hedging direction and no dispersion effect in the direction of the dispersion force, which can effectively avoid the loss of greater force. Therefore, when striking and releasing to rebound, the force is strong, the rebound is also fast, the strength perception is easier, the strength is held more accurately, the fitting for feet is good, and the tone after the striking is transparent. The double-stepping linkage pedal for the bass drum of the jazz drum according to the present invention has the following advantages over the prior art: the down-stepping force is easy to control, the striking tone is transparent, and the loss of the down-stepping force and rebound force is reduced, so that the hammerheads 8 move more smoothly, and the pedal fits the foot and rebounds fast with easier control.

Referring to the related figures in FIGS. 1 to 11, a double-stepping linkage pedal for a bass drum of a jazz drum according to the present invention can be implemented by the following technical solutions on the basis of the previous technical solutions: Each the left hammerhead assembly and the right hammerhead assembly includes a hammerhead rod 7 and a hammerhead 8 fixed on the top of the hammerhead rod 7 in a position-adjustable manner, wherein a lower part of each hammerhead rod 7 is respectively fixed to a moving part of the corresponding left pedal assembly and a moving part of the corresponding right pedal assembly; an upper part of the left tension spring assembly and an upper part of the right tension spring assembly are fixed to the hammerhead rod 7 which are the corresponding side in a position-adjustable manner; a lower part of the left tension spring assembly and a lower part of the right tension spring assembly are respectively rotatably connected to the corresponding left pedal assembly and the corresponding right pedal assembly in a position-adjustable manner, so that a swinging direction of the left tension spring assembly and a swinging direction of the right tension spring assembly are respectively consistent with a front-back swinging direction of the corresponding hammerhead rod 7. In this way, the hammerheads 8 are used for striking the bass drum, and the hammerhead rods 7 are used for supporting the hammerheads 8. In addition, the position of each hammerhead 8 can be adjusted up and down, and both the hammerheads 8 and the hammerhead rods 7 can be locked after the hammerheads 8 are adjusted in position by locking screws 35 and nuts. A lower part of the left hammerhead rod 7 is fixed to the moving part of the left pedal assembly, and a lower part of the right hammerhead rod 7 is fixed to the moving part of the right pedal assembly. In this way, the movement of the moving part of the left pedal assembly drives the left hammerhead rod 7 to swing clockwise forwards or counterclockwise backwards, thereby driving the left hammerhead 8 to strike the bass drum or leave away from the bass drum. Similarly, the movement of the moving part of the right the pedal assembly drives the right hammerhead rod 7 to swing clockwise forwards or counterclockwise backwards, thereby driving the right hammerhead 8 to strike the bass drum or leave away from the bass drum. At the same time, because the upper part of the left tension spring assembly and the upper part of the right tension spring assembly correspond to the corresponding hammerhead rod 7 assembly in a position-adjustable manner, that is, the degree of tension of the tension springs 13 can be adjusted to control the rebound force when the left pedal assembly or the right pedal assembly is released. In other words, if a larger rebound force is required, the length of each tension spring 13 can be adjusted to be larger, that is, the upper part of the left tension spring assembly and the upper part of the right tension spring assembly are fixed at a higher position of the upper part of the corresponding hammerhead rod 7 assembly. On the contrary, if the required rebound force is not particularly large, the length of each tension spring 13 can be reduced, that is, the upper part of the left tension spring assembly and the upper part of the right tension spring assembly are fixed at a lower position of the upper part of the corresponding hammerhead rod 7 assembly. The lower part of the left tension spring assembly and the lower part of the right tension spring assembly are respectively rotatably connected to the corresponding left pedal assembly and the corresponding right pedal assembly in a position-adjustable manner, so that the swinging direction of the left tension spring assembly and the swinging direction of the right tension spring assembly are respectively consistent with a front-back swinging direction of the corresponding hammerhead rod 7. In this way, when the moving part of the left pedal assembly moves, the left hammerhead rod 7 and the left tension spring assembly are driven to swing clockwise forwards or counterclockwise backwards at the same time, so that the hammerheads 8 strike the bass drum with appropriate strength or quickly drive the hammerheads 8 to rebound. The left tension spring assembly and the right tension spring assembly are rotatably connected to the left pedal assembly and the right pedal assembly in a position-adjustable manner. The adjustable position means that the position of the lower end of the tension spring 13 of the left tension spring assembly can adjust the longitudinal extension direction of the tension spring 13 during their linkage, and the arrangement direction and position of the tension spring 13 are ensured to be the most suitable direction and position. All the above-mentioned technical solutions are to realize that the swinging directions of the left tension spring assembly and the right tension spring assembly are consistent with the swinging directions of the corresponding left hammerhead rod 7 and the corresponding right hammerhead rod 7. On the basis of the previous technical solutions, a further preferred technical solution is as follows: each hammerhead rod 7 is fixed on the moving part of the corresponding left pedal assembly and the moving part of the corresponding right pedal assembly in a position-adjustable manner with a hammerhead rod seat 6; the lower part of each hammerhead rod 7 is fixedly connected to the upper part of the corresponding hammerhead rod seat 6 in a position-adjustable manner; and each hammerhead rod seat 6 is detachably fixedly connected to the moving part of the corresponding left pedal assembly and the moving part of the corresponding right pedal assembly. In this way, each hammerhead rod seat 6 is detachably fixedly connected to the moving part of the corresponding left pedal assembly and the moving part of the corresponding right pedal assembly, and the lower part of each hammerhead rod 7 is fixed on the upper part of the corresponding hammerhead rod seat 6 in a position-adjustable manner. Each hammerhead rod seat 6 can be a hollow tube; the lower part of each hammerhead rod 7 is inserted into the corresponding hammerhead rod seat 6, and then each hammerhead rod seat 6 is provided with a threaded hole 34 or a through hole; each hammerhead rod 7 can be detachably fixed on the corresponding hammerhead rod seat 6 by screwing in the corresponding screw 35 or a screw rod and the corresponding nut; the fixed position can be adjusted up and down, and then the position of each hammerhead 8 away from the bass drum can be adjusted, and then the height of striking to the drum surface can be adjusted, and then the tone and volume of striking the bass drum can be adjusted. Of course, each hammerhead rod 7 can also be detachably fixedly connected to the corresponding left pedal assembly and the corresponding right pedal assembly through other devices such as a sleeve or a clamp. The previous technical solutions may specifically be as follows: the upper part of each hammerhead rod seat 6 is horizontally provided with a through threaded hole 34 from an outer wall to an inner wall, each hammerhead rod 7 is inserted into the upper part of the corresponding hammerhead rod seat 6, and each hammerhead rod 7 is detachably fixed to the corresponding hammerhead rod seat 6 by rotating the corresponding screw 35 into the corresponding threaded hole 34. The end of each screw 35 is pressed against the outer wall of the corresponding hammerhead rod 7 to further fix the hammerhead rod 7 on the corresponding hammerhead rod seat 6. The previous technical solutions may also be as follows: a side end cover 5 is fixed at the lower part of one side of each hammerhead rod seat 6, and each side end cover 5 is fixed to the moving part of the corresponding left pedal assembly and the moving part of the corresponding right pedal assembly. In this way, the movement of the moving part of the left pedal assembly or the right pedal assembly drives the corresponding side end cover 5 to swing clockwise forwards or counterclockwise backwards, thereby driving the corresponding hammerhead rod seat 6 to swing. Finally, the hammerhead rods 7 are driven by the hammerhead rod seats 6, so that the hammerheads 8 strike the bass drum forwards or leave from the bass drum backwards, finally achieving the purpose of the present invention.

Referring to the related figures in FIGS. 1 to 11, a double-stepping linkage pedal for a bass drum of a jazz drum according to the present invention can also be as follows on the basis of the previous technical solutions: each the left tension spring assembly and the right tension spring assembly includes a tension spring 13 and a tension spring clamp 10, wherein the upper part of each tension spring 13 is fixedly connected with the upper part of the corresponding hammerhead rod seat 6 in a position-adjustable manner, a lower part of each tension spring 13 is hinged on the corresponding tension spring clamp 10, the lower parts of the hammerhead rod seats 6 are provided with a main shaft 4, each tension spring clamp 10 is detachably fixed on the other side of the main shaft 4 in a rotatably position-adjustable manner, the main shaft 4 sequentially penetrates through the left hammerhead rod seat 6, the left tension spring clamp 10, the right hammerhead rod seat 6 and the right tension spring clamp 10 from left to right, and the lower end of the left hammerhead rod seat 6 and the right hammerhead rod seat 6 are respectively rotatably connected to the main shaft 4. The main function of each tension spring 13 is to generate a rebound force, and after the left pedal assembly and the right pedal assembly are released, the left hammerhead assembly and the right hammerhead assembly can return to original positions. The upper part of each tension spring 13 is fixed to the upper part of the corresponding hammerhead rod seat 6, and their fixed position can be adjusted. In this way, the length of each tension spring 13 can be adjusted, and then the tension force and rebound force of each tension spring 13 can be adjusted. The lower part of each tension spring 13 is hinged to the corresponding tension spring clamp 10, so that the direction can be adjusted at any time during the rebound and tension of the tension spring 13, and so the minimum deformation can be used to deal with the external force. The main shaft 4 arranged at the lower parts of the hammerhead rod seats 6 does not be rotated, its function is connecting the lower parts of the hammerhead rod seats 6 and the lower parts of the tension spring clamps 10 to the main shaft 4, so that they are ensured not to move up and down, and it can be expediently realized that the hammerhead rods 7 and the tension springs 13 swing in the same direction. Each tension spring clamp 10 is detachably fixed on the other side of the main shaft 4 in a rotatably angle-adjustable manner, so that the lower part of each tension spring 13 is movably connected to the moving part of the corresponding left pedal assembly and the moving part of the corresponding right pedal assembly in a position-adjustable manner. When the moving parts of the left pedal assembly and the right pedal assembly move, the left hammerhead rod seat 6 and the right hammerhead rod seat 6 are driven to swing clockwise forwards or counterclockwise backwards around the main shaft 4. At the same time, the upper part of the left tension spring 13 and the upper part of the right tension spring 13 are driven to swing in the same direction in a linkage manner. Because the lower end of each tension spring 13 is hinged on the corresponding tension spring clamp 10, and the tension spring clamps 10 are fixed on the main shaft 4, it is guaranteed that each tension spring 13 follows the corresponding hammerhead rod seat 6 to swing in the same direction during the linkage swing. On the basis of the previous technical solutions, a further preferred technical solution is listed as follows: the lower end of each tension spring 13 is connected with a tension spring ring 12, and the lower end of each tension spring ring 12 is hinged to the upper part of the corresponding tension spring clamp 10. In this way, the lower part of each tension spring 13 is hinged to the upper part of the corresponding tension spring clamp 10 by arranging the corresponding tension spring ring 12. Of course, the lower end of each tension spring 13 can be hinged to the corresponding tension spring clamp 10 in other ways. On the basis of the previous technical solutions, a further preferred technical solution is listed as follows: a tension spring shaft 11 extends transversely at a middle position of the upper part of the corresponding tension spring clamp 10, and the lower part of each tension spring ring 12 is hinged on the tension spring shaft 11. In this way, each tension spring ring 12 passes through the corresponding tension spring shaft 11 and be set on the corresponding tension spring shaft 11. Each tension spring ring 12 can rotate around the corresponding tension spring shaft 11. Thus, when each tension spring 13 swings in the same direction as the corresponding hammerhead rod seat 6, the corresponding tension spring ring 12 rotates on the corresponding tension spring shaft 11 to continuously adjust the position of the lower part of the tension spring 13, so that the tensioning and retracting directions of the tension spring 13 are continuously adjusted to follow the swinging direction of the corresponding hammerhead rod seat 6, thus reducing the mutual loss of energy between them. Further, the force of beating and rebounding is relatively strong, and the rebound is fast. On the basis of the previous technical solutions, a further preferred technical solution is listed as follows: a tension spring rod 14 is connected to the upper part of each tension spring 13, and the upper part of each tension spring rod 14 is fixed to the upper part of the corresponding hammerhead rod seat 6 in a position-adjustable manner. The function of each tension spring rod 14 is to fix the corresponding tension spring 13 on the upper part of the corresponding hammerhead rod seat 6 in a position-adjustable manner. To realize the adjustment of the tension force and rebound force of each tension spring 13, the initial length of the tension spring 13 can be adjusted according to a user's habits, and then the tension force and rebound force of the tension spring 13 can be adjusted. On the basis of the previous technical solutions, a further preferred technical solution is as follows: the upper part of each hammerhead rod seat 6 is laterally fixedly provided with a tension spring rod mounting seat 29, and the upper part of each tension spring rod 14 is fixed on the corresponding tension spring rod mounting seat 29 in a position-adjustable manner. Each tension spring rod mounting seat 29 can conveniently fix the corresponding tension spring rod 14 on the upper part of the corresponding hammerhead rod seat 6 in a position-adjustable manner. On the basis of the previous technical solutions, a further preferred technical solution is listed as follows: each tension spring rod mounting seat 29 is provided with a through hole, the upper part of each tension spring rod 14 is a threaded rod, and tension spring adjusting nuts 38 are arranged on and under each tension spring rod mounting seat 29; the upper part of each tension spring rod 14 is threadedly connected to the corresponding tension spring adjusting nuts 38; the upper and lower tension spring adjusting nuts 38 can fix the upper part of each tension spring rod 14 to the corresponding tension spring rod mounting seat 29 in a position-adjustable manner; by rotating the tension spring adjusting nuts 38, the tension spring rods 14 are raised or lowered, and the lengths of the tension springs 13 are changed to realize the adjustment of the tension force of the tension springs 13, thereby adjusting the rebound force of the entire tension spring assembly. This adjustment manner is simpler, and the adjustment is more accurate. Of course, other manners can also be used to realize the position adjustment of the tension spring rods 14. For example, each tension spring rod mounting seat 29 is provided with a threaded hole 34, the upper part of each tension spring rod 14 is a threaded rod, and each threaded rod is threadedly connected in the corresponding threaded hole 34 in a position-adjustable manner. Each threaded rod is threadedly connected in the corresponding threaded hole 34. Rotating each threaded rod can move the corresponding tension spring rod 14 upwards or downwards. If each tension spring rod 14 moves upwards, the length of the corresponding tension spring 13 increases, and the tension force and rebound force will be greater. Conversely, if each tension spring rod 14 moves downwards, the length of the corresponding tension spring 13 decreases, and the tension force and the rebound force become smaller. On the basis of the previous technical solutions, a further preferred technical solution is listed as follows: the lower part of each tension spring clamp 10 is provided with clips on both their front and rear sides, an opening is formed between the two clips, and the tension spring clamps 10 are rotatably arranged on the main shaft 4 in a position-adjustable manner. In this way, the two clips of each tension spring clamp 10 have an opening in the middle, and the position of each opening can adjust the distance between the corresponding two clips. Each tension spring clamp 10 is clamped on the main shaft 4, and then the corresponding two clips are loosened; the tension spring clamp 10 can be rotated on the main shaft 4 to adjust the rotational angle thereof, and then the position of the lower end of the corresponding tension spring 13 can be adjusted. After the angle of each tension spring clamp 10 is adjusted, the two clips are clamped, so that the opening between the two clips is reduced, and the inner wall of the entire tension spring clamp 10 is tightened and hooped and fix on the main shaft 4. Each adjusted tension spring clamp 10 ensures that the position of the hinge point at the lower end of the corresponding tension spring 13 is suitable for swinging in the same direction as the corresponding hammerhead rod 7 assembly and has minimal loss. On the basis of the previous technical solutions, a further preferred technical solution is listed as follows: threaded holes 34 are formed in the clips, and the screws 35 are rotated into the threaded holes 34 so that the two clips can be removably clamped and fixed on the main shaft 4. This manner is relatively simple and convenient to operate, and the clamping effect is better. Of course, through holes may be formed in the clips, and the screw rod or bolt passes through the through hole and then is fixedly connected with a nut to fix the two clips together. On the basis of the previous technical solutions, a further preferred technical solution is listed as follows: a tension spring shaft sleeve 9 is arranged between the main shaft 4 and each tension spring clamp 10 in a sleeving manner. The function of each tension spring shaft sleeve 9 is to resist wear and avoid wear between the main shaft 4 and the corresponding tension spring clamp 10.

Referring to the related figures in FIGS. 1 to 11, a double-stepping linkage pedal for a bass drum of a jazz drum according to the present invention can also be listed as follows on the basis of the previous technical solutions: each the left pedal assembly and the right pedal assembly includes an upright column assembly, a foot pedal 16 for resting a foot, a bottom plate 3 and a pedal driving device, wherein the bottom of each upright column assembly is fixed on the corresponding bottom plate 3; an upper part of each upright column assembly supports the left hammerhead assembly and the right hammerhead assembly at a corresponding position; an upper part of each pedal driving device is drivingly connected to the left hammerhead assembly and the right hammerhead assembly at a corresponding position; a lower part of each pedal driving device is connected to the bottom plate 3 at a corresponding position; a rear end of each foot pedal 16 is connected to the corresponding bottom plate 3; and the initial position of a front end of each foot pedal 16 is higher than the position of the rear end of the foot pedal 16. In this way, the upright column assemblies are used for supporting the left hammerhead assembly and the right hammerhead assembly, and the bottom plates 3 are used for supporting the entire double-stepping linkage pedal for the bass drum of the jazz drum, and at the same time, also driving the entire device to move together, making it convenient to carry and take. When it is in use, a foot steps on each foot pedal 16 and presses the foot pedal 16 downwards; the rear end of the foot pedal 16 is connected to the corresponding bottom plate 3, and the front end of the foot pedal 16 moves downwards, thus driving the corresponding pedal driving device to move, and driving the corresponding left hammerhead assembly and the corresponding right hammerhead assembly to move. The left hammerhead assembly and the right hammerhead assembly swing clockwise forwards, and at the same time, the pedal driving devices drive the left tension spring assembly and the right tension spring assembly to swing clockwise forwards. In this way, the left hammerhead 8 and the right hammerhead 8 strike the bass drum to complete the striking action, while the left tension spring 13 and the right tension spring 13 are stretched to form and accumulate a tension force. When the foot is lifted, the front end of each foot pedal 16 moves upwards under the action of the corresponding tension spring 13; the corresponding pedal driving device is driven to move and return to its original position; at the same time, the left tension spring 13 and the right tension spring 13 return to their original positions to generate a rebound force, and then the left hammerhead assembly and the right hammerhead 8 assembly at the corresponding positions are driven to move counterclockwise backwards, thereby causing the left hammerhead 8 and the right hammerhead 8 to leave from the bass drum in preparation for the next striking of the bass drum. The initial position of the front end of each foot pedal 16 is higher than the position of the rear end of the foot pedal 16. In this way, in the initial position, the user's foot steps down to ensure that the pedal driving devices can achieve driving of the left hammerhead assembly and the right hammerhead assembly, as well as the left tension spring assembly and the right tension spring assembly in the same swinging direction. On the basis of the previous technical solutions, a further preferred technical solution is listed as follows: the upright column assembly of the left pedal assembly is a left upright column 2, and the upright column assembly of the right pedal assembly includes a middle upright column 22 and a right upright column 1. The left upright column 2 and the middle upright column 22 support and fix the left pedal assembly and the left hammerhead assembly, the middle upright column 22 and the right upright column 1 support and fix the right pedal assembly and the right hammerhead assembly. During use, the left pedal assembly and the right pedal assembly are used together. Of course, the upright column assembly of the left pedal assembly can be composed of one upright column, that is, the upright column assembly of the left pedal assembly is the left upright column 2. The upright column assembly of the right pedal assembly includes the middle upright column 22 and the right upright column 1. In this way, the three upright columns are arranged in order from left to right to be the left upright column 2, the middle upright column 22 and the right upright column 1. The three upright columns can support the left hammerhead assembly, the left tension spring assembly, the right hammerhead assembly and the right tension spring assembly. One less upright column makes the structure more compact, lighter in weight, and easier to carry and assemble. Of course, each upright column assembly can also include a left upright column and a right upright column. The advantages of this arrangement are as follows: the stability is high, the left pedal assembly and the right pedal assembly have less mutual influence, and the energy loss is further reduced. On the basis of the previous technical solutions, a specific technical solution may be listed as follows: the rear end of each foot pedal 16 is hinged to the corresponding bottom plate 3 through a pedal shaft 18, each pedal shaft 18 is erected on the corresponding bottom plate 3, and the rear end of each foot pedal 16 sleeves the corresponding pedal shaft 18. In this way, the entire pedals can rotate clockwise upwards or counterclockwise downwards with the pedal shafts 18 as the axes. In other words, the front end of each foot pedal 16 moves up or down, thereby driving the corresponding pedal driving device to move clockwise upwards or counterclockwise downwards, and driving the left hammerhead rod 7 and the right hammerhead rod 7 to move, and further driving the left hammerhead 8 and the right hammerhead 8 to move clockwise forwards to strike the bass drum or move counterclockwise downwards to leave from the bass drum. This method makes the pedaling of the foot smoother, the movement is smoother, and the perception of the foot that is stepping on each foot pedal 16 is stronger. Regarding the previous preferred technical solution, the specific technical solution that can be implemented is listed as follows: each pedal shaft 18 is fixed on the corresponding bottom plate 3 through a pedal bearing seat 19 that is erected on the bottom plate 3, the bottom of each pedal bearing seat 19 is fixed on the corresponding bottom plate 3, and each pedal shaft 18 is arranged on the upper part of the corresponding pedal bearing seat 19. In this way, because each pedal shaft 18 is erected on the corresponding bottom plate 3 through the corresponding pedal bearing seat 19, the rear end of each foot pedal 16 can be conveniently hinged to the corresponding bottom plate 3, so that the rear end of each foot pedal 16 rotates clockwise or counterclockwise around the corresponding pedal shaft 18. On the basis of the previous technical solutions, a further preferred technical solution is listed as follows: each pedal shaft 18 is hinged with a pedal rear hinge 17, and the front and middle parts of each pedal rear hinge are fixed to the rear part of the corresponding foot pedal 16. In this way, since the front and middle parts of each pedal rear hinge are fixed to the rear part of the corresponding foot pedal 16, the fixed area of the two is increased, the fixing is more firm and not easy to damage, the force is transmitted more evenly, and there is no left or right movement to affect the movement trajectory of the entire foot pedals 16.

Referring to the related figures in FIGS. 1 to 11, a double-stepping linkage pedal for a bass drum of a jazz drum according to the present invention can also be listed as follows on the basis of the previous technical solutions: each driver includes a bent rod 21 and a chain 24, wherein a rear end of each bent rod 21 is hinged with the front end of the corresponding foot pedal 16, a front end of each bent rod 21 is in clearance swing connection with a lower half section of the corresponding chain 24, and a lower end of each chain 24 is connected to the corresponding bottom plate 3; each linkage device is a chain wheel 23, each chain wheel 23 is connected with an upper part of the corresponding chain 24, and each chain wheel 23 is respectively fixed to the lower part of the corresponding left hammerhead assembly and the lower part of the corresponding right hammerhead assembly. In this way, the rear end of each chain 24 is connected to the corresponding bottom plate 3, so that the rear end of the chain 24 cannot move toward left and right, and each bent rod 21 is hinged with the front end of the corresponding foot pedal 16. When the front end of each foot pedal 16 moves clockwise downwards or counterclockwise upwards, because each chain 24 is connected to the front end of the corresponding bent rod 21, the chain 24 hinders the movement of the front end of the bent rod 21. Thus, the front end of the bent rod 21 is moved counterclockwise upwards or clockwise downwards, and at the same time, the lower end of the chain 24 is driven to move counterclockwise downwards or clockwise upwards. Since each chain wheel 23 is connected to the upper part of the corresponding chain 24, the lower end of the chain 24 moves clockwise downwards or counterclockwise upwards, thereby driving the left hammerhead assembly and the right hammerhead assembly at corresponding positions to swing clockwise forwards or counterclockwise backwards, and striking the bass drum or staying away from the bass drum to prepare for the next striking. Of course, other combinations of the driver and the linkage device can be adopted, as long as the foot pedals 16 can be stepped, and then the down-stepping force is transmitted to the left hammerhead assembly and the right hammerhead assembly at the corresponding positions, so that the corresponding left hammerhead 8 on the left hammerhead assembly and the right hammerhead 8 on the right hammerhead assembly can strike the bass drum or stay away from the bass drum. On the basis of the previous technical solutions, a further preferred technical solution is listed as follows: the lower end of each chain 24 is connected to the corresponding bottom plate 3 through a chain pull rod 25 and a chain pull rod seat 27; the lower end of each chain 24 is relatively rotatably connected to the head end of the corresponding chain pull rod 25; the rear end of each chain pull rod 25 is hinged to the front end of the corresponding chain pull rod seat 27, and the rear end of each chain pull rod seat 27 is movably connected to the corresponding bottom plate 3. In this way, the lower end of each chain 24 can be connected to the corresponding bottom plate 3 to prevent the lower end of the chain 24 from moving back and forth to affect the transmission of the force of the corresponding bent rod 21. More specifically, the front end of each chain pull rod 25 is hinged to the lower end of the corresponding chain 24 through a pull-down rod shaft 26, and the rear end of each chain pull rod 25 is hinged connected to the corresponding chain pull rod seat 27 through a chain pull rod shaft 28. In addition, a further preferred technical solution is listed as follows: the specific connection between each bent rod 21 and the corresponding chain 24 is listed as follows: the front end of the bent rod 21 is provided with a threaded hole 34, and the corresponding screw 35 passes through the gap in the middle of the chain 24 and then is connected to the threaded hole 34 at the front end of the bent rod 21, so that the front end of the bent rod 21 and the middle and rear end of the chain 24 can be connected. Of course, a through hole can also can be formed at the front end of the bent rod 21; a bolt or screw 35 passing through a gap and a through hole in the lower part of the chain 24 is fixed to a nut, so that the front end of the bent rod 21 are connected to the middle and rear end of the chain 24. The upper end of the chain 24 is fixed to the corresponding chain wheel 23. The chain wheel 23 may also be provided with a threaded hole 34, the screw 35 passes through the gap at the upper end of the chain 24 and then passes through the threaded hole 34 and is screwed into the threaded hole 34, thereby fixing the upper end of the chain 24 on the chain wheel 23.

Referring to the related figures in FIGS. 1 to 11, another preferred technical solution for a double-stepping linkage pedal for a bass drum of a jazz drum according to the present invention can be as follows on the basis of the previous technical solutions: each pedal driving device includes a driver and a linkage device, wherein one end of each driver is hinged with the front end of the corresponding foot pedal 16, the other end of each driver is hinged with the corresponding linkage device, and each linkage device is respectively fixed to the lower part of the corresponding left hammerhead assembly and the lower part of the corresponding right hammerhead assembly. One end of each driver is hinged with the front end of the corresponding foot pedal 16, and such driver is used to transmit clockwise forward movement or counterclockwise backward movement of the front end of the foot pedal 16. The other end of each driver is hinged with the corresponding linkage device, and meanwhile, each linkage device is respectively fixed to the lower part of the corresponding left hammerhead assembly and the lower part of the corresponding right hammerhead assembly. In this way, each linkage device can generate a clockwise forward or counterclockwise backward force with the clockwise forward movement or counterclockwise backward movement of the corresponding driver, thereby driving the left hammerhead assembly or the right hammerhead assembly at the corresponding position to swing forwards clockwise or swing backwards counterclockwise. The left hammerhead 8 and the right hammerhead 8 corresponding to the line of sight strike the bass drum or leave from the bass drum to prepare for the next striking. On the basis of the previous technical solutions, a more preferred technical solution is listed as follows: each driver is a fish-shaped pull rod 36, and each linkage device is a linkage crank seat 37, wherein a lower end of each fish-shaped pull rod 36 is hinged with the front end of the corresponding foot pedal 16, and an upper end of each fish-shaped pull rod 36 is hinged with an outer end of the corresponding linkage crank seat 37; and an inner end of each linkage crank seat 37 is respectively fixed to the lower part of the corresponding left hammerhead assembly and the lower part of the corresponding right hammerhead assembly. The lower end of each fish-shaped pull rod 36 is hinged with the front end of the corresponding foot pedal 16, so that the movement of the front end of the foot pedal 16 can drive the lower end of the fish-shaped pull rod 36 to move. The upper end of each fish-shaped pull rod 36 is hinged with the outer end of the corresponding linkage crank seat 37, thus, the counterclockwise downward movement and the clockwise upward movement of each foot pedal 16 are finally transmitted to the lower part of the corresponding left hammerhead assembly and the lower part of the corresponding right hammerhead assembly through the hinge of the upper end of the corresponding fish-shaped pull rod 36, and the corresponding linkage crank seat 37, so that the left hammerhead assembly and the right hammerhead assembly at the corresponding positions swing clockwise forwards and swing counterclockwise backwards accordingly. A further specific technical solution can be listed as follows: each fish-shaped pull rod 36 is hinged with the front end of the corresponding foot pedal 16 through a pedal front hinge 20, a lower end of each pedal front hinge is fixed to the front end of the corresponding foot pedal 16, and an upper end of each pedal front hinge 20 is hinged with the lower end of the corresponding fish-shaped pull rod 36. In this way, the downward force is transmitted to the corresponding fish-shaped pull rod 36 through each pedal front hinge 20 with a relatively large area, so that the movement of the fish-shaped pull rod 36 is more stable to prevent the fish-shaped pull rod from shaking left and right, thereby affecting the movement stability of the corresponding linkage crank seat 37.

Referring to the related figures in FIGS. 1 to 11, a double-stepping linkage pedal for a bass drum of a jazz drum according to the present invention can also be as follows on the basis of the previous technical solutions: the linkage device in the left pedal assembly is fixed to the lower part of the left hammerhead assembly through a connecting rod 33, a left end of the connecting rod 33 is fixed to the linkage device in the left pedal assembly, and a right end of the connecting rod 33 is fixed to the lower part of the left hammerhead assembly. In this way, the movement of the linkage device of the left pedal assembly can be transmitted to the lower part of the left hammerhead assembly through the connecting rod 33, so that the left hammerhead assembly drives the left hammerhead 8 to swing clockwise forwards to strike the bass drum or to swing counterclockwise backwards to be away from the bass drum. The left end of the connecting rod 33 is fixed to the linkage device of the left pedal assembly, and the right end of the connecting rod 33 is fixed to the lower part of the left hammerhead assembly, so that power transmission can be realized. On the basis of the previous technical solutions, a further preferred technical solution is listed as follows: a linkage shaft is fixed in the center of the linkage device in the left pedal assembly, and a right end of the linkage shaft is fixed to the left end of the connecting rod 33 through a shaft locking device 31. In this way, the right end of the linkage device in the left pedal assembly is fixed to the left end of the connecting rod 33 through the linkage shaft and the shaft locking device 31 to facilitate the long-distance transmission of the movement of the linkage device to the left hammerhead assembly, so that the left hammerhead assembly drives the left hammerhead 8 to swing clockwise forwards or counterclockwise backwards. On the basis of the previous technical solutions, a further preferred technical solution is listed as follows: a right end of the connecting rod 33 is fixedly connected by a connecting rod end cover 15, the connecting rod end cover 15 is fixed at the lower part of the left hammerhead assembly, and a left end of the connecting rod end cover 15 is fixed to the right end of the connecting rod 33. In this way, the connecting rod 33 can be fixed to the lower part of the above-mentioned left hammerhead assembly. The chain wheel 23 of the left pedal assembly may also be fixed to the shaft locking device 31 through a pedal connecting shaft 30. A chain wheel sleeve 32 is arranged between the pedal connecting shaft 30 and the chain wheel 23 to avoid wear between the chain wheel 23 and the pedal connecting shaft 30.

The above description is only illustrative of some specific embodiments of the present disclosure, but should not be regarded as the protection scope of the present disclosure. Any equivalent change or modification or equal scale enlargement or reduction, etc. made according to the design spirit of the present disclosure shall be deemed to fall within the protection scope of the present disclosure.

What is claimed is:

1. A double-stepping linkage pedal for a bass drum of a jazz drum, comprising:

a left pedal assembly, a right pedal assembly, a left hammerhead assembly, a right hammerhead assembly, a left tension spring assembly and a right tension spring assembly, wherein the left pedal assembly is drivingly connected to the left hammerhead assembly in a front-rear swinging manner, so that a front end of the left pedal assembly moves up and down to drive the left hammerhead assembly to swing back and forth;

the left tension spring assembly and the left hammerhead assembly are elastically linked to the left pedal assembly in a swinging direction front-rear consistent manner;

the right pedal assembly is drivingly connected to the right hammerhead assembly in a front-rear swinging manner, so that a front end of the right pedal assembly moves up and down to drive the right hammerhead assembly to swing back and forth; and the right tension spring assembly and the right hammerhead assembly are elastically linked to the right pedal assembly in a swinging direction front-rear consistent manner;

wherein the left hammerhead assembly and the right hammerhead assembly both comprises:

a hammerhead rod, and a hammerhead fixed on a top of the hammerhead rod in a position-adjustable manner;

a lower part of each of the hammerhead rods is respectively fixed to a moving part of the corresponding left pedal assembly and a moving part of the corresponding right pedal assembly;

an upper part of the left tension spring assembly and an upper part of the right tension spring assembly are fixed to the hammerhead rod at the corresponding side in a position-adjustable manner;

a lower part of the left tension spring assembly and a lower part of the right tension spring assembly are respectively rotatably connected to the corresponding left pedal assembly and the corresponding right pedal assembly in a position-adjustable manner, so that a swinging direction of the left tension spring assembly and a swinging direction of the right tension spring assembly are respectively consistent with a front-back swinging direction of the corresponding hammerhead rod.

2. The double-stepping linkage pedal for the bass drum of the jazz drum according to claim 1, wherein each of the hammerhead rods is fixed on the moving part of the corresponding left pedal assembly and the moving part of the corresponding right pedal assembly in a position-adjustable manner through a hammerhead rod seat;

the lower part of each of the hammerhead rods is fixedly connected to an upper part of the corresponding hammerhead rod seat in a position-adjustable manner; and each of the hammerhead rod seats is detachably fixedly connected to the moving part of the corresponding left pedal assembly and the moving part of the corresponding right pedal assembly.

3. The double-stepping linkage pedal for the bass drum of the jazz drum according to claim 2, wherein the left tension spring assembly and the right tension spring assembly both comprises: a tension spring, and a tension spring clamp;

an upper part of each of the tension springs is fixedly connected with the upper part of the corresponding hammerhead rod seat in a position-adjustable manner, and a lower part of each of the tension springs is hinged on the corresponding tension spring clamp;

the lower parts of the hammerhead rod seats are provided with a main shaft, and each of the tension spring clamps is detachably fixed on the other side of the main shaft in a rotatably position-adjustable manner;

the main shaft sequentially penetrates through a left hammerhead rod seat, a left tension spring clamp, a right hammerhead rod seat and a right tension spring clamp from left to right; and a lower end of the left hammerhead rod seat and the right hammerhead rod seat are respectively rotatably connected to the main shaft.

4. The double-stepping linkage pedal for the bass drum of the jazz drum according to claim 1, wherein the left pedal assembly and the right pedal assembly both comprise: an upright column assembly, a foot pedal for resting a foot, a bottom plate, and a pedal driving device, wherein a bottom of each of the upright column assemblies is fixed on the corresponding bottom plate;

an upper part of each of the upright column assemblies support the left hammerhead assembly and the right hammerhead assembly at a corresponding position;

an upper part of each of the pedal driving devices is drivingly connected to the left hammerhead assembly and the right hammerhead assembly at a corresponding position;

a lower part of each of the pedal driving devices is connected to the bottom plate at a corresponding position;

a rear end of each of the foot pedals is connected to the corresponding bottom plate; and an initial position of a front end of each of the foot pedals is higher than a position of the rear end of the foot pedal.

5. The double-stepping linkage pedal for the bass drum of the jazz drum according to claim 4, wherein the rear end of each of the foot pedals is hinged with a rear part of the corresponding bottom plate, and the front end of each of the foot pedals is hinged with the corresponding pedal driving device.

6. The double-stepping linkage pedal for the bass drum of the jazz drum according to claim 4, wherein each of the pedal driving devices comprises: a driver, and a linkage device, wherein one end of each of the drivers is hinged with the front end of the corresponding foot pedal, the other end of each of the drivers is hinged with the corresponding linkage device, and each of the linkage devices is respectively fixed to the lower part of the corresponding left hammerhead assembly and the lower part of the corresponding right hammerhead assembly.

7. The double-stepping linkage pedal for the bass drum of the jazz drum according to claim 6, wherein each of the drivers comprises: a bent rod, and a chain, wherein a rear end of each of the bent rods is hinged with the front end of the corresponding foot pedal, a front end of each of the bent rods is in clearance swing connection with a lower half section of the corresponding chain, and a lower end of each of the chains is connected to the corresponding bottom plate;

each of the linkage devices is a chain wheel, each of the chain wheels is connected with an upper part of the corresponding chain, and each of the chain wheels is respectively fixed to a lower part of the corresponding left hammerhead assembly and a lower part of the corresponding right hammerhead assembly.

8. The double-stepping linkage pedal for a bass drum of a jazz drum according to claim 6, wherein the linkage device in the left pedal assembly is fixed to the lower part of the left hammerhead assembly through a connecting rod, a left end of the connecting rod is fixed to the linkage device in the left pedal assembly, and a right end of the connecting rod is fixed to the lower part of the left hammerhead assembly.

9. The double-stepping linkage pedal for the bass drum of the jazz drum according to claim 8, wherein a linkage shaft is fixed in a center of the linkage device in the left pedal assembly, and a right end of the linkage shaft is fixed to the left end of the connecting rod through a shaft locking device.

* * * * *